United States Patent [19]

Lee

[11] Patent Number: 4,877,140

[45] Date of Patent: Oct. 31, 1989

[54] ROTATING CLOTHES TREE

[76] Inventor: Kil J. Lee, 508 Crocker Ave., Pacific Grove, Calif. 93950

[21] Appl. No.: 227,084

[22] Filed: Aug. 1, 1988

Related U.S. Application Data

[63] Continuation-in-part of Ser. No. 48,324, May 11, 1987, abandoned.

[51] Int. Cl.[4] ..... A47F 5/02

[52] U.S. Cl. ..... 211/163; 211/205

[58] Field of Search ..... 211/163, 205, 131, 133, 211/33, 54.1, 57.1, 59.1, 194, 196; D6/411–415

[56] References Cited

U.S. PATENT DOCUMENTS

| | | | |
|---|---|---|---|
| D. 67,680 | 6/1925 | Ziegler | 211/33 X |
| D. 127,028 | 5/1941 | Warren | D6/413 X |
| 346,293 | 7/1886 | Lavaggi | 211/33 |
| 3,310,180 | 3/1967 | Neagle | 211/205 |
| 3,547,275 | 12/1970 | Engel | 211/205 |
| 4,453,640 | 6/1984 | Cillario | 211/194 X |

FOREIGN PATENT DOCUMENTS

| | | | |
|---|---|---|---|
| 2019456 | 11/1971 | Fed. Rep. of Germany | 211/205 |

*Primary Examiner*—Reinaldo P. Machado
*Assistant Examiner*—Sarah A. Lechok Eley
*Attorney, Agent, or Firm*—Vernon D. Beehler; William H. Pavitt, Jr.; Ralf A. Siegemund

[57] ABSTRACT

A disassembleable clothes or other garment rack or stand having a base, a supporting axle rod extending upwardly from the base and a plurality of spool-like elements separated from each other, and disposed for rotation about the rod at different height levels, and each said element having angularly, upwardly extending peg-type hangers insertable into it, with each of said elements and its hangers being greater in size and extent than the element and its hangers at the level immediately below. The stand may be converted into a decorative simulated tree by providing an annular support member having a plurality of spaced-apart coaxial rings disposed on the top of the base arm branches hung from the peg hangers and resting upon the coaxial rings.

2 Claims, 3 Drawing Sheets

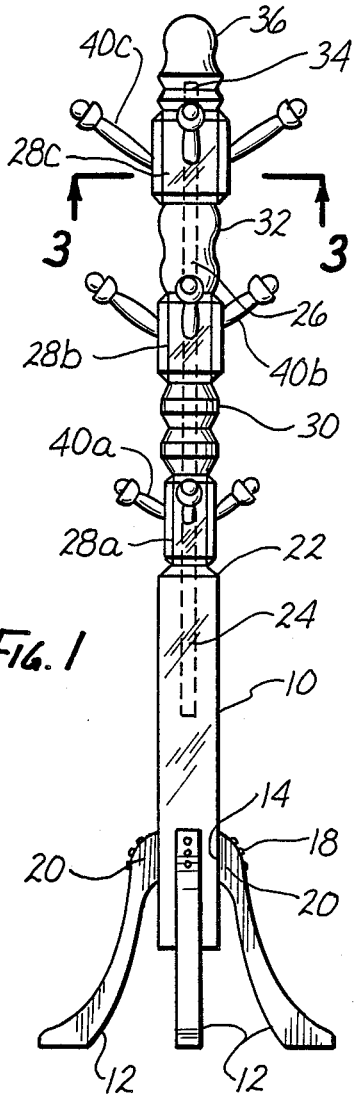
FIG. 1
FIG. 2
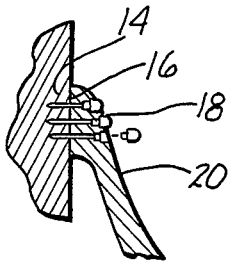
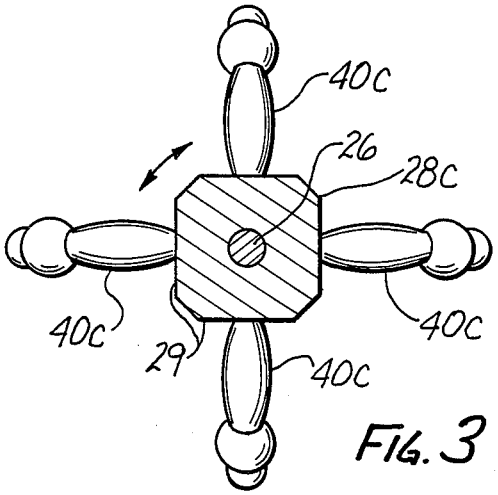
FIG. 3
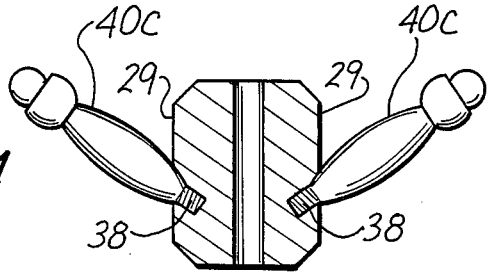
FIG. 4

62
47a
47b
47a
47b
22
44
47c
10
47c

ROTATING CLOTHES TREE

This application is a continuation-in-part of application Ser. No. 07/048,32 now abandoned filed May 11, 1987.

FIELD OF THE INVENTION

This invention relates to clothes trees such as would be placed in homes and offices, and particularly to one which may be converted to serve as an artificial Christmas tree.

BACKGROUND OF THE INVENTION

Various types of hat and coat racks, clothes stands, and clothes trees have been devised since at least the early days of colonies. Subsequent to the American Civil War, some attention was given to providing cloak or clothes stands which would rotate. Examples of such stands may be seen as follows in the early patents to:

| INVENTOR | PATENT NO. |
|---|---|
| J. R. Palmenbury | 48,989 |
| S. A. Parker | 381,414 |
| F. Wolf | 478,386 |
| E. Leger | 649,734 |
| F. Wolf | 922,991 |
| M. Kozlowski | 1,258,756 |
| Leon M. Levinthal | 3,788,489 |

In addition, revolving devices have been provided to support neckties (No. 1,466,564); displays (No. 3,424,313); saddles (No. 3,315,819); and powder dispensers (No. 4,582,225).

Further, in the course of the prosecution of the application Ser. No. 07/048,324 of which the present is a continuation in part, the following additional patents have been cited by the Examiner:

| INVENTOR | PATENT NO. |
|---|---|
| Lavaggi | 346,293 |
| Ziegler | 67,680 |
| Warren | 127,028 |
| Neagle | 3,310,180 |
| Engel | 3,547,275 |
| Schramm (West Germany) | 2,019,456 |
| Cillario | 4,453,640 |

For one reason or another, revolving clothes or coat racks, are seldom, if ever, seen in use today. Conceivably, this could be because devices made of elaborate ironworks, such as are illustrated and described in the patents to Palmenbury (No. 48,989), Parker (No. 381,414), Leger (No. 649,734), and Wolf (No. 922,991), would appear to be both expensive to fabricate, cumbersome to carry and properly locate, and not aesthetically appealing. As a consequence, most clothes trees or clothes racks found today comprise simple vertical wooden members supported by a plurality of legs or some other base, and a plurality of hooking devices radiating from the upper end of and fastened to the member by screws or bolts. Usually these clothes trees or stands are placed against a wall or in a corner in such a manner that coats or other garments to be hung therefrom, can only be hooked onto one or two sides, and not on the hooks extending toward the wall or the walls against which the stand is placed. It is desirable therefore, to provide for rotation of the hooking elements, as was apparently appreciated more than one hundred years ago.

In addition, clothes trees ordinarily have but a single function, namely, to receive and hold one or more coats, hats, scarves, and other garments. They seldom, if ever, serve any other purpose, and particularly, any decorative function.

It is also, however, most important that any revolving clothes tree or stand, whatever other function it may perform, be both inexpensive to fabricate and assemble, light in weight so that it can be easily moved about in a room or other location, occupy a minimum amount of space, and be pleasing in appearance. It is also desirable from a marketing standpoint for a clothes tree or rack to be packaged compactly in a disassembled state, but easily and securely assembled in whatever place it is to be placed for use.

The prior art falls short of achieving all of these objectives.

SUMMARY OF THE INVENTION

According to the present invention, a vertical base member is provided and supported at its lower end by, preferably, four downwardly and outwardly extending legs secured to such base member. The base member is orificed downwardly from its upper end for a predetermined distance to support a vertically extending cylindrical rod inserted in the orifice. Slipped onto this rod, which serves as an axle, are a plurality of spool-like element each having a center portion which may be cylindrical or multi-faceted, and being centrally orificed to allow the axle-rod to be passed through its core for rotatable support by and about the axle rod. Desirably spacers should be interposed between each of the spool-like elements. These spacers may be either attached to an adjacent spool-like element, or entirely separated therefrom so as to be independently rotatable from the spool-like elements. The top of the rod may be capped with a knoblike member having an orifice extending upwardly from its lower end to receive the upper end of the rod.

Each of the spool-like elements which are preferably fabricated of wood, may be drilled downwardly at an angle from its side in several locations angularly spaced from each other, and provided with threading into which may be screwed wooden peglike hanger members. The latter will serve as upwardly directed projections adapted to receive either a hanger carrying a garment, or the garment itself directly. Each spool-like element and its peg-like members may be greater in size and extent than the spool-like element and its peg-like members next below it. Thereby, garments hung on he upper peg-like members will not tend to fall on top of garments hung on the lower members, and the former garments may be rotated about the vertical axis of the tree or rack without also necessarily pulling around the garments hung on the lower hanger elements.

It may be thus seen that the present invention provides an exceedingly simple clothes or garment tree or stand, having a plurality of independently rotatable sets of peg hangers. The entire tree or stand may be readily disassembled into, or fabricated as, its several parts. In the latter case, the parts may be conveniently packaged in a relatively small box for assembly by its purchaser. When assembled, the tree or stand will be found to be quite light, so that it may be readily moved into any convenient location. Its several spool-like elements from which the hooking peg members project upwardly, may be rotated into any desired angular disposition. Moreover, because of its extremely simple construction, it is esthetically pleasing even when it is set up by itself and is not carrying any garments.

The clothes tree or stand of the present invention, therefore, obviates many of the features of prior art devices which apparently caused them to be rejected by the public despite the desirability of having hanger rotating capabilities.

It is also a feature of the present invention that the clothes tree may readily be converted to use as a simulated decorative Christmas tree. This may be accomplished by providing an annular support member having a central ring which may be seated on the top of the vertical base member before the axle rod is inserted down into the orifice and the spool-like elements are slipped down over the rod. When so assembled, the annular support member will be held in place co-axially with the rod and spool-like members.

Desirably, the annular support member will comprise a series of supporting co-axial rings secured in fixed relationship to each other by a plurality of arms radiating from the central ring. The radius of each of the supporting rings is preferrably determined to provide support for a hanging straight line decorative element, the upper end of which is hooked on or attached to an end of a peg hanger, in such a manner that each such decorative element will be disposed in an imaginary co-axial cone. Thus, those decorative elements hooked on, or attached to the uppermost peg hangers will be disposed in a cone having the greatest base diameter; those hooked on or attached to the second tier of peg hangers, in a cone having a smaller base diameter; and those, hooked on or attached to the lowermost tier of peg hangers, in a cone having the smallest base diameter. The decorative elements may comprise a rigid wire or other member, having at regular spaced intervals a series of balls of fluffy material or needles, with the result that, when all such elements are hooked onto the proper peg-like elements and laid on their respective support rings, the thus covered clothes tree assumes the shape of a conifer, and as such, looks like a Christmas tree.

The assembly may be further decorated by providing a lamp mounting at the top of the rod, which, when made as a hollow tube, may serve to carry an electric cord up through the base member when it also is made hollow.

The device of the present invention, thus, not only may serve as a clothes tree, but may also be readily converted to an attractive simulated Christmas tree.

DESCRIPTION OF THE DRAWINGS

In the drawings:

FIG. 1 is a side elevation of the preferred embodiment of the present invention.

FIG. 2 is an enlarged section of juncture of the base with the right hand leg shown at the base of FIG. 1.

FIG. 3 is a sectional view taken on line 3—3 of FIG. 1 in the direction of the arrows.

FIG. 4 is a vertical sectional view of the upper rotatable element when removed from the stand combination.

DESCRIPTION OF THE PREFERRED EMBODIMENT

Figure 5:
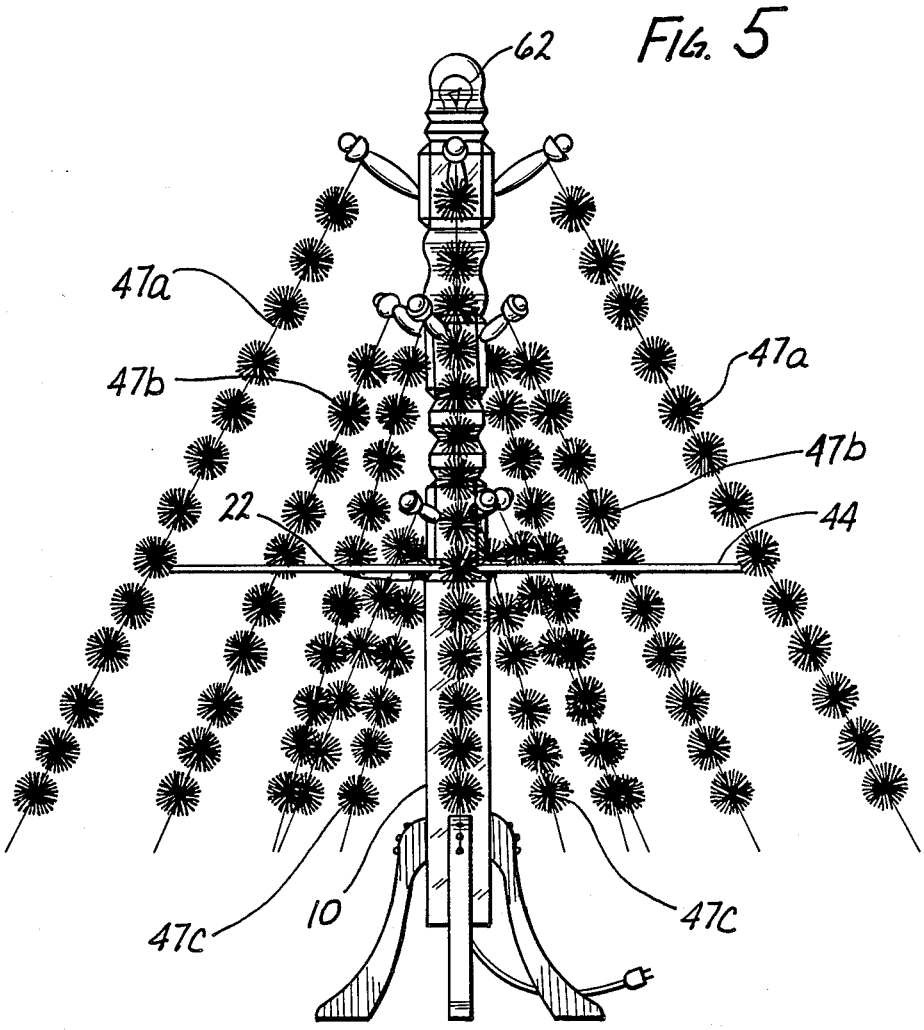
FIG. 5 is a side elevation of a modification of the embodiment of FIG. 1.
Figure 7:
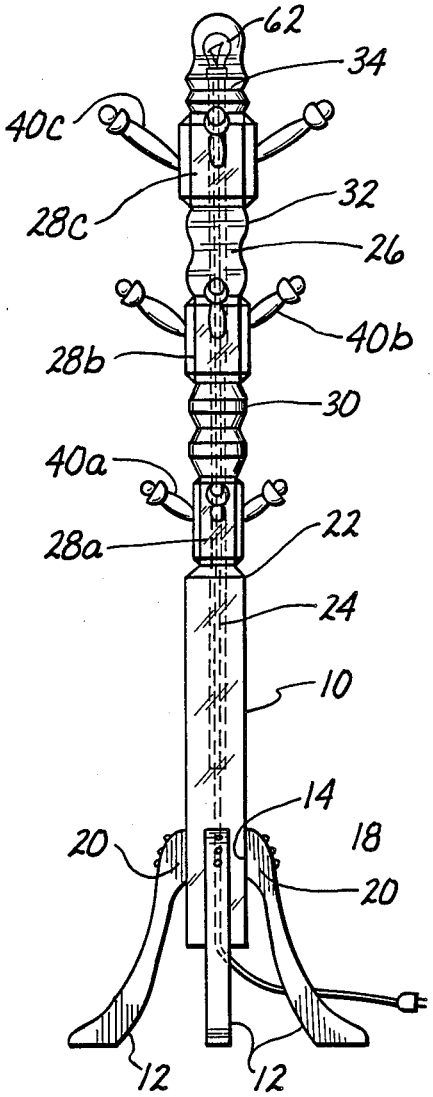
FIG. 7 is a side elevation of a modification of the FIG. 1 embodiment.
Figure 6:
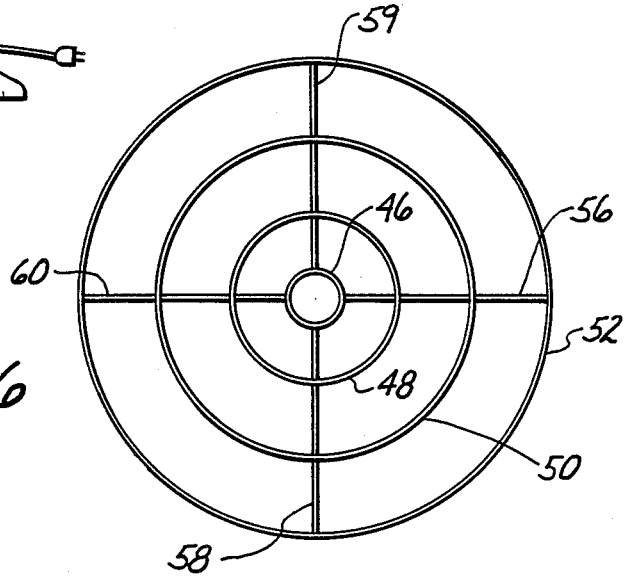
FIG. 6 is a plan view of the annular support member shown mounted on the top of the base member in FIG. 5 and supporting the decorative elements as therein illustrated.

Referring to the drawings, a cylindrical base member 10 is supported by a plurality of legs 12 in an upright position. Desirably, the base member 10 may be fabricated of wood and drilled where each of the upper or head portions 20 of the legs 12 would attach at 14 to the member 10. For secure support, preferably at least three drill holes 16 are provided to receive screws 18 which pass through the head portion 20 of each leg 12.

The upper end 22 of the member 10 is coaxially orificed at 24 for at least a portion of the length of the member 10 to receive an axle rod 26 for support in a vertical orientation. After the axle rod 26 has been dropped into the orifice 24, a plurality of spool-like elments **28*a*, 28*b*, and 28*c* may be slipped onto the rod 26. However, desirably, spacers 30 and 32 should be interposed between adjacent spool-like elements 28*a* and 28*b*, and 28*b* and 28*c*. The spacers 30 and 32 may be of any esthetic configuration and may either be entirely separate from either of the spool like elements 28*a*, 28*b*, or 28*c*, between which they are interposed, or, if desired, may be attached to one of the adjacent elements 28*a*, 28*b*, or 28*c* or formed integrally therewith. The dimension of the axle rod 26 in relation to the combined axial dimensions of the spool-like elements 28*a*, 28*b*, or 28*c*, and the spacers 30 and 32, may be such as to leave a small segment 34 at the top of the rod 26 onto which an orificed cap 36** may be placed to provide a finished look for the assembled clothes tree or stand.

Each of the spool-like elements **28*a*, 28*b*, 28*c* is preferably square or octagonal in cross-section as shown in FIG. 3, thereby to provide a plurality of symetrically disposed vertical facet walls about the element's axis, although the elements could each be circular in, or of other preferably symmetrical cross-section, without departing from the scope of the present invention. However the side walls of the elements 28*a*, 28*b*, and 28*c* are faceted, each is desirably threadedly drilled at 38 at an upwardly extending angle to receive matingly threaded peg members 40 which serve as coat hooks or hanger hooks. Thus, as shown in FIG. 4, a peg 40 is threaded into each of the four sides 29 of the spool-like elements 28*a*, 28*b*, and 28*c* to extend outwardly and at 90 degree spacing from adjacent pegs 40**.

From the construction thus described and illustrated, it may be readily appreciated that, when assembled, each of the elements 28 may be rotated about the rod 26, thus to enable a garment to be disposed about the rod axis at any point about the assembly. In this connection, it should be noted that it is also a feature of the present invention to provide increasing size and extent of the spool-like elements **28*a*, 28*b*, and 28*c*, and their respective peg members 40, with the rise in the levels of their respective dispositions on the rod 26. Thus, it will be noted that element 28*b* and its members 40*b* are respectively larger than element 28*a* and its members 40*a*; and 28*c* and its members 40*c* are, in turn, respectively larger than 28*b* and its members 40*b*.**

As a consequence of this size difference, it will be appreciated that clothes hung on the upper pegs **40*c* will not tend to pile up on the clothes hung on the second tier of pegs 40*b*; nor will those hung on tier 40*b* tend to pile up on the clothes hung on the pegs 40***a*. This arrangement results in a much neater looking coat or garment rack when numerous garments may be placed upon it, as in a restaurant or other public place. In addition, the clothes hung on each spool-like element 28*b*, 28*c* and its respective peg members 40*b*, 40*c* may be rotated without necessarily causing clothes hanging on the lower peg members 40*a*, 40*b* also to be rotated.

By virtue of the construction of the clothes rack of the present invention, it will also be readily appreciated that the whole device may be packed in a box no longer than the length of the axial rod 26. The height and width of the box may also be kept quite small since the various parts may be separately fabricated and assembled for packing, and include only the base member 10, the legs 12, the spool-like members 28*a*, 28*b*, and 28*c* with their respective detached peg elements 40*a*, 40*b* and 40*c*, the spacers 30 and 32, and the cap 36. Because of such convenience in packing and easy assembly to produce a simple aesthetically appearing clothes or garment rack or tree, the assembly of the present invention will have great marketability and utility, and will be readily accepted by the public which appears long ago to have rejected rotating clothes racks described and illustrated in the prior art patents, such as have been hereinabove referred to in this specification.

The present invention also lends itself to adaption as a decorative Christmas tree as shown in FIG. 5. This may be simply accomplished by providing an annular support member 44 having a central ring 46 which may be mounted on the upper end 22 of the base member 10, and a plurality of rigid decorative branches 47.

The arrangement of the support members 44 is best shown in FIG. 5. Coaxial with the central ring 44 are three annular support elements 48, 50 and 52, all of which are held in spaced relationship by radii 54, 56, 58 and 60, each in a 90 degree relationship with its adjacent radii. The branches 47 are each hooked at their upper extremities onto one of the peg-like members 40*a*, 40*b*, 40*c*, and are laid down on one of the annular support elements 48, 50 and 52 in a particular pattern, so that when all branches 47 are properly disposed, the result is the appearance of a simulated Christmas tree as shown in FIG. 5.

To attain this result, the diameter of the outside annular support element 52 must be such, as to result in the branches 47*a*, which are hooked onto the peg-like members 40*c* and rested on the element 52, lying in an imaginary conical surface centered about the axis of the base member 10. Further, desirably each of the respective diameters of elements 50 and 48 should be similarly calculated with reference to the branches 47*b* and 47*c* which will be hooked onto the peg-like elements 40*b* and 40*a* respectively, thereby to dispose the branches 47*b* and 47*c* also in co-axial imaginary cones about the base member 10.

The clothes tree of the present invention may be further decoratively enhanced by providing a lamp 62 at the top 64 of the structure. For this purpose, a lamp holder 66 may be substituted for the cap 36 shown in the FIG. 1 embodiment, and the axle rod 26' is hollowed to enable an electrical cord 68 to be passed down through a passage 70 extending down from the bottom of the orifice 24, which supports the hollow rod 26', to extend out and below the base to where the cord 68 may be connected to an electrical outlet not shown.

It will be appreciated, then, that not only may the present invention serve as a convenient clothes tree, but it may at appropriate times readily be converted to a decorative tree not intended to function as a clothes repository.

I claim:

1. A convertible clothes stand comprising:

(a) a base member, said member being at least partially axially orificed, from its top downwardly, said base member including means to support said base member on a horizontal surface with the axis of said orifice in a substantially vertical orientation;

(b) a cylindrical axle rod, said rod having a portion of a configuration to fit into the orifice in said base member, and being inserted therein;

(c) a plurality of spool-like elements disposed in series on said axle rod, each of said spool-like elements having an internal diameter slightly greater than the external diameter of said axle rod, thereby being rotatable about said axle rod, and each of said spool-like elements being rotatable independently of the others;

(d) a plurality of support arms longitudinally extending angularly upwardly from, and disposed equiangularly about, each of said spool-like elements to support a coat or other garment therefrom;

(e) each spool-like element above the lowermost said element being of a greater outside diameter than that immediately below it, and each support arm extending from the spool-like element above the lowermost such element, being of a greater longitudinal dimension than that of any of the arms extending from the spool-like element immediately below;

(f) the support arms extending from each spool-like element being vertically spaced from the arms extending from the adjacent spool-like element (g) an annular support member mounted on top of the base member, the last said support member comprising:

(i) a central mounting ring fitting about the axle rod and resting on top of the base member, and (ii) a plurality of coaxial annular support elements secured in spaced relationship to each other and to said mounting ring by a plurality of struts radiating from said ring and to which struts said annular support elements are secured; and (h) a plurality of decorative rigid branch members, each branch member being secured at one of its extremities to one of said support arms to hand downwardly therefrom and to supportingly rest upon one of said annular support elements, with all branch members depending from the support arms extending from a particular spool-like member, supportingly resting upon the same annular element for disposition in an imaginary cone coaxial with said axle rod.

2. The convertible clothes stand as described in claim 1 wherein lamp means are disposed above the uppermost spool-like element, the base member is provided with a further axial orifice of lesser diameter than that into which the axle rod fits and co-axial therewith, said further orifice extending through said base member, said axle rod is hollow, and an electrical cord is passed from below the base member through said further axial orifice and hollow axle rod to the lamp means to enable the latter means to be illuminated.

* * * * *